US006640838B2

(12) United States Patent
Finzo

(10) Patent No.: US 6,640,838 B2
(45) Date of Patent: Nov. 4, 2003

(54) MANUALLY ACTUATED STRAPPING UNIT FOR WRAPPING A STEEL STRAP AROUND A PACKAGED ITEM

(75) Inventor: Flavio Finzo, Würenlos (CH)

(73) Assignee: Orgapack GmbH, Dietikon (CH)

( * ) Notice: Subject to any disclaimer, the term of this patent is extended or adjusted under 35 U.S.C. 154(b) by 0 days.

(21) Appl. No.: 10/151,299

(22) Filed: May 21, 2002

(65) Prior Publication Data

US 2002/0179175 A1 Dec. 5, 2002

(30) Foreign Application Priority Data

May 21, 2001 (CH) ..... 0945/01

(51) Int. Cl.[7] ..... B21F 9/02
(52) U.S. Cl. ..... 140/93.2; 140/152
(58) Field of Search ..... 140/93 R, 93.2, 140/123.5, 123.6, 150, 152

(56) References Cited

U.S. PATENT DOCUMENTS 4,398,572 A 8/1983 Fromm
5,029,433 A 7/1991 Werk

*Primary Examiner*—Lowell A. Larson
(74) *Attorney, Agent, or Firm*—Lowe Hauptman Gilman & Berner LLP

(57) ABSTRACT

A manually actuated transportable strapping unit for wrapping a tightening strap around a packaged item (58) which unit includes a base plate (1) which is provided with a supporting surface **(1*b*) for arranging on a packaged item. The unit further includes a sealing device which is provided with a pivotable die-plate carrier (3) which can be pivoted with respect to the base plate (1), about a first bearing point (2), which is provided in the region of a front end (1*a*) of the base plate (1), from an open end position into a sealing end position and vice versa. A die-plate (13) is arranged on the die-plate carrier (3), which die-plate (13) can be lowered by the pivoting movement of the die-plate carrier (3) in the direction of a punch (6) arranged in the base plate (1) for which purpose a sealing-device lever (26) is provided which can be pivoted about a second bearing point (22) and whose pivoting movement can be transmitted to the die-plate carrier (3) via a transmission element (20) in a force-transmitting contact region of the die-plate carrier (3). The unit includes separating means on the die-plate carrier (3), with which the strap can be severed, and is provided with a tensioning device with which a strap tension can be applied to the tightening strap, the tensioning device having a tensioning lever (39) with which a tensioning wheel (38) arranged on a tensioning shaft (43) can be actuated. At least in the sealing end position, a contact region of the transmission element (20) with the die-plate carrier (3) is arranged, with respect to a direction running at least substantially parallel to the orientation of the strap between the sealing device and the tensioning wheel (38)**, approximately level with the separating means or behind the separating means.

16 Claims, 16 Drawing Sheets

MANUALLY ACTUATED STRAPPING UNIT FOR WRAPPING A STEEL STRAP AROUND A PACKAGED ITEM

The invention relates to a mobile and exclusively manually actuated strapping unit according to the preamble of claim 1.

Strapping units of this type are provided for mobile use so that a user can wrap a steel strap around a packaged item in any desired location. This type of strapping unit typically has a sealing device which produces a connection of two layers of the steel strap by means of multiple notchings, without using an additional sealing element, such as, for example a lead seal. For this type of strapping unit it is also typical for both the strap tension and the formation of a seal to be produced manually without the assistance of outside energy, in particular electric or hydraulic energy. For this purpose, the operator of a strapping unit according to the generic type has only to provide his own muscular power.

However, this entails a number of concept-induced problems, for example that a sufficiently large force can be provided in order to form the seal. In order to be able to apply as large a force as possible, particularly right at the beginning of the contact of the die-plate, which is arranged in the die-plate carrier, with the steel strap, the die-plate carrier is mounted pivotably. By this means, initially only a relatively small surface of the die-plate comes into contact with the steel strap. The high surface pressure caused as a result is intended to ensure that the metal strap is sufficiently deformed from the beginning.

A strapping unit of this type is shown, for example, in U.S. Pat. No. 4,398,572. In this case, however, it is disadvantageous that there is a concentration of mass in the region over the front end of the base plate of the strapping unit. This distribution of weight results in a "top-heaviness" which makes the handling of the unit more difficult.

The invention is therefore based on the object of providing a unit of the type mentioned at the beginning with improved handleability.

This object is achieved according to the invention in the case of a strapping unit according to the preamble of claim 1 according to a first aspect in that at least in the sealing end position of the sealing-device lever a contact region of the transmission element with the die-plate carrier is arranged, with respect to a direction running parallel to the orientation of the strap between the sealing device and the tensioning wheel, approximately level with the separating means or behind the separating means. This is synonymous with shifting the contact region (and therefore preferably also the bearing point of the sealing-device lever on the strapping unit) toward the tensioning device. This enables, in an advantageous manner, a more balanced distribution of weight to be obtained than is the case with the unit described in U.S. Pat. No. 4,398,572. In the case of the unit from U.S. Pat. No. 4,398,572, its transmission element, therefore also the rotational shaft of the sealing-device lever, is arranged upstream of the notching tool in the tensioning direction, which causes the concentration of mass, which is to be avoided by the invention, in the region of the top-end rotational bearing of the unit.

In addition, this solution affords the advantage that a lever arm, with which the transmission element, with respect to the bearing point of the die-plate carrier on the strapping unit, presses onto the die-plate carrier, is extended. This enables a relatively large torque to be produced with respect to the bearing point of the die-plate carrier, as a result of which a sufficiently large force for deforming the strap can be ensured in a very reliable manner, particularly at the beginning of the sealing process.

However, considerable advantages can also be obtained with the device according to the invention if, in comparison to previously known strapping units, it is not required to increase the torque acting on the die-plate carrier. A relatively long lever arm, which can be obtained according to the invention, between the bearing point of the die-plate carrier and the contact region of the transmission element with the die-plate carrier enables the forces acting in order to produce a seal to be reduced. These are the forces which, starting from the die-plate carrier, act between a bearing surface for the steel strap on the upper side of the base plate and the bearing point for the sealing-device lever. This means, in an advantageous manner, that those components of the strapping unit which are provided here, can be of less solid dimensions than hitherto. This also results in a reduction in weight in the front region of the strapping unit and therefore improves the handleability of the unit.

According to a further aspect, the object in the case of a strapping unit as described in the preamble of claim 1 and in which the tensioning wheel is mounted on a pivotable rocker is also achieved in that a bearing axis of the rocker and a rotational axis of the sealing-device lever are at least substantially aligned with each other. This also signifies, with respect to a horizontal direction of the strapping unit along the base plate, a shifting of the rocker axis in the direction of the rear end of the base plate toward the tensioning wheel and results in an advantageous distribution of weight. This solution even affords the further advantage that because two previously separated bearing points are consolidated, a reduction in the number of required individual parts can be obtained. A particularly favorable solution in terms of structure can be provided here by the rocker and the transmission element being arranged on the same shaft. The reduction in the required individual parts concerns, in particular, components which, in the case of previously known strapping units according to the generic type, are situated above the front half of the base plate and therefore contribute to the top-heaviness.

In an advantageous embodiment, provision can be made according to the invention that during a transfer of the die-plate carrier from its open end position into the sealing end-position, the point at which the transmission element is in contact with the die-plate carrier migrates in order to transmit the movement of the sealing-device lever to the die-plate carrier. The contact region preferably changes in such a manner that the normal force vector of the transmitted force encloses, together with an orthogonal of the supporting surface of the base plate, at an angle which increases toward the sealing end position during a pivoting movement of the sealing-device lever. This firstly enables the lever arm to be further increased and secondly enables the force profile at the free end of the sealing-device lever to be improved.

Further preferred embodiment of the invention emerge from the dependent claims, the description and the drawing.

The invention will be explained in greater detail with reference to exemplary embodiments illustrated schematically in the figures, in which.

Figure 1:
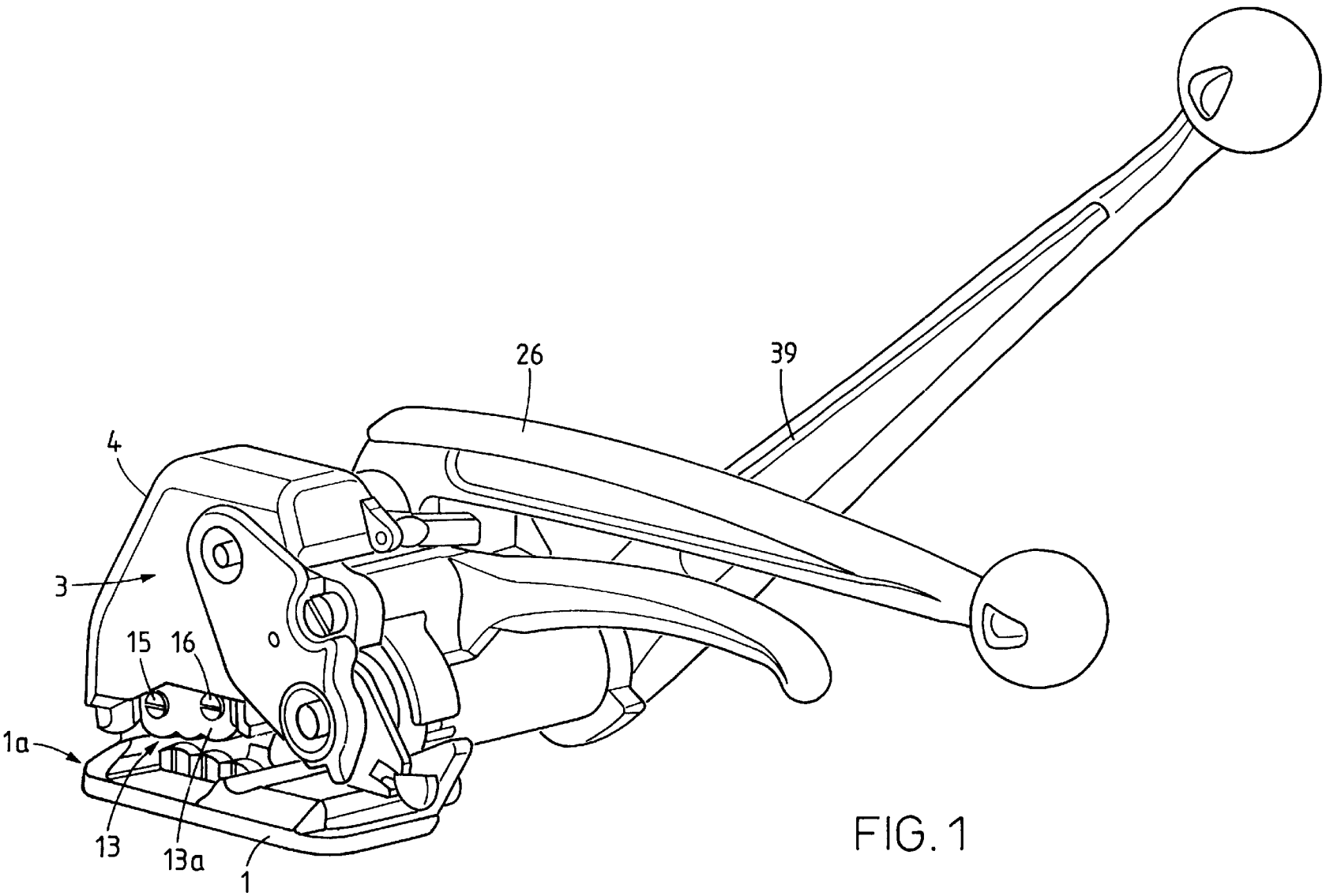
FIG. 1 shows a perspective illustration of a strapping unit according to the invention.
Figure 2:
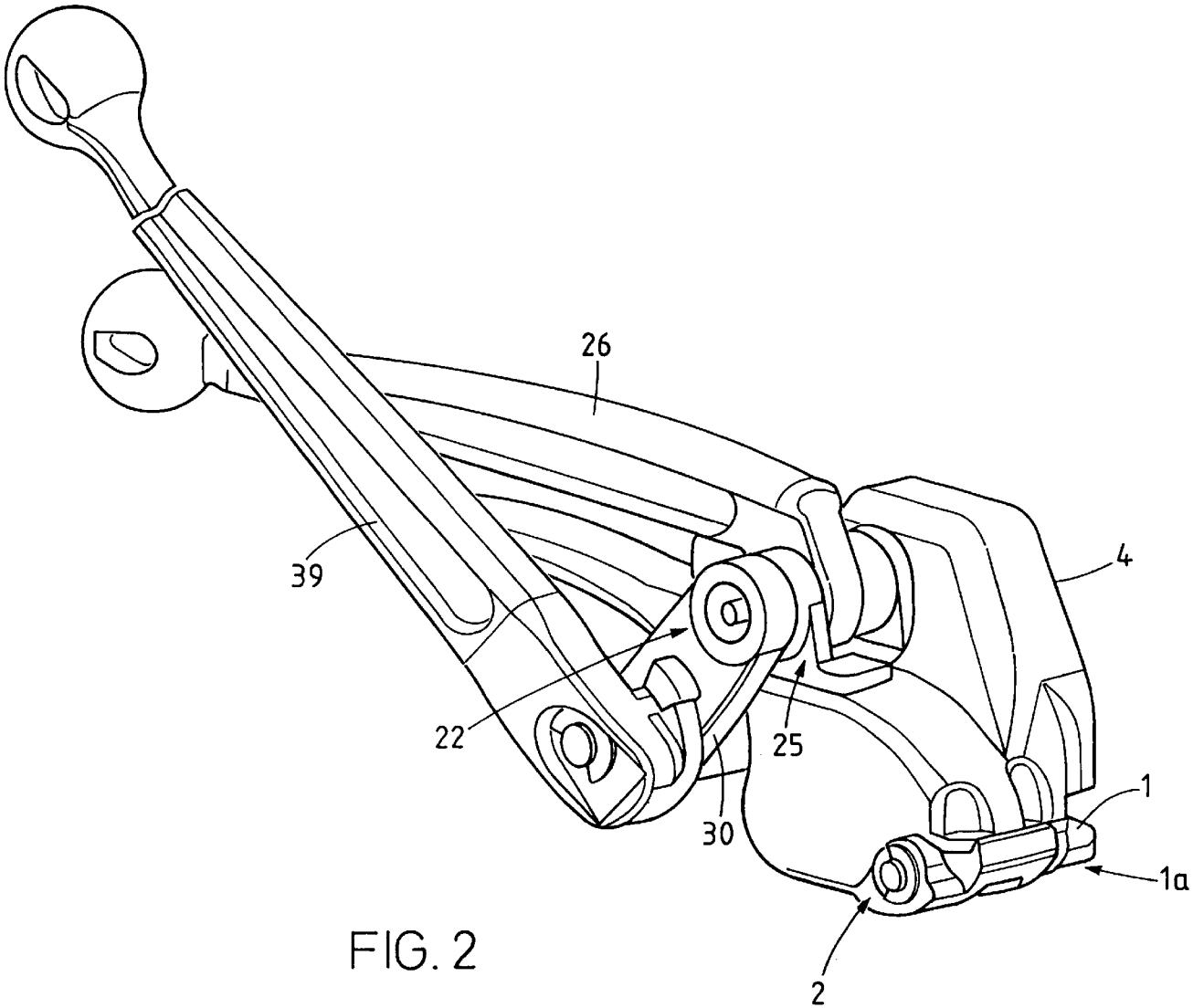
FIG. 2 shows the strapping unit of FIG. 1 in a different perspective illustration.
Figure 3A:
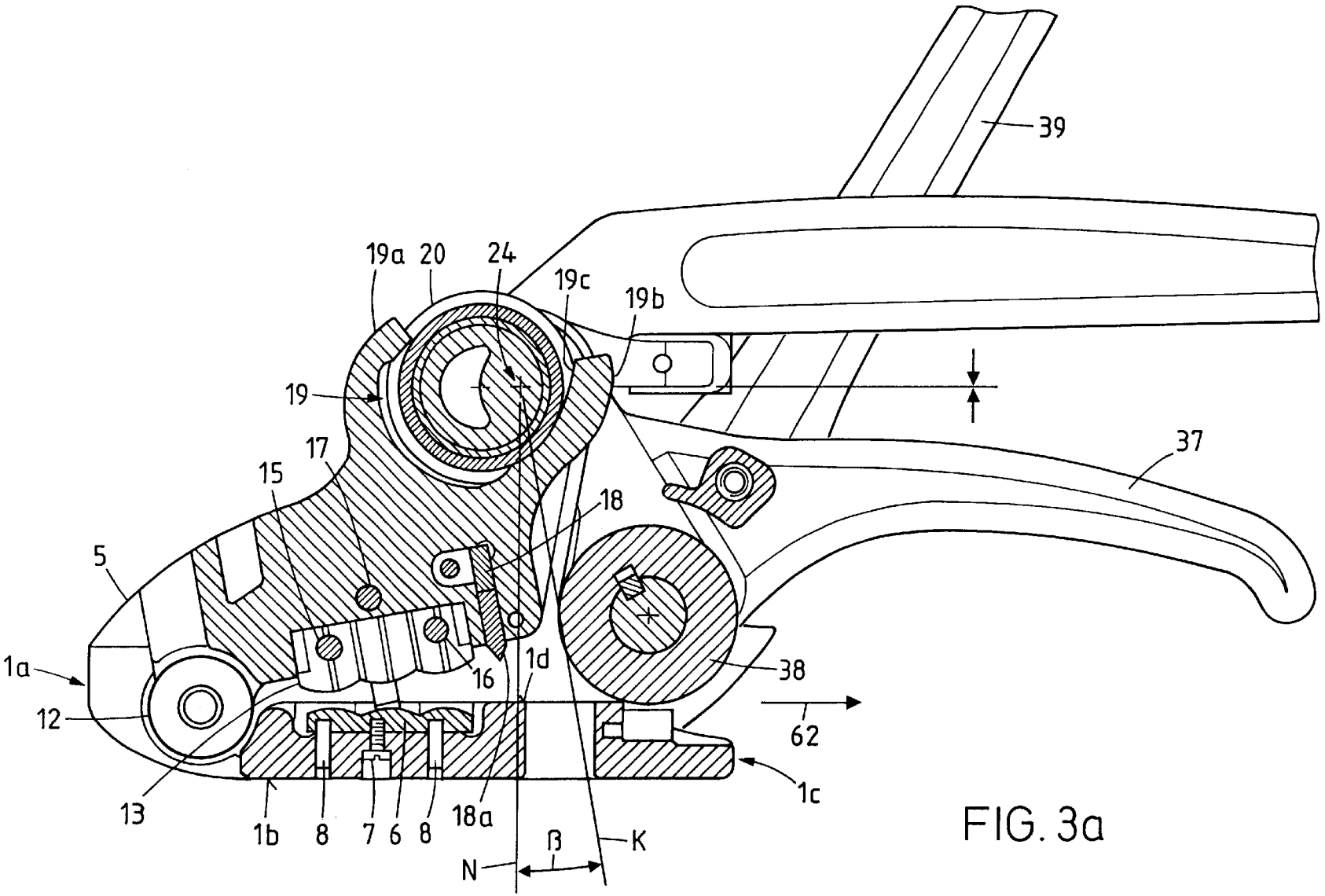
Figure 3B:
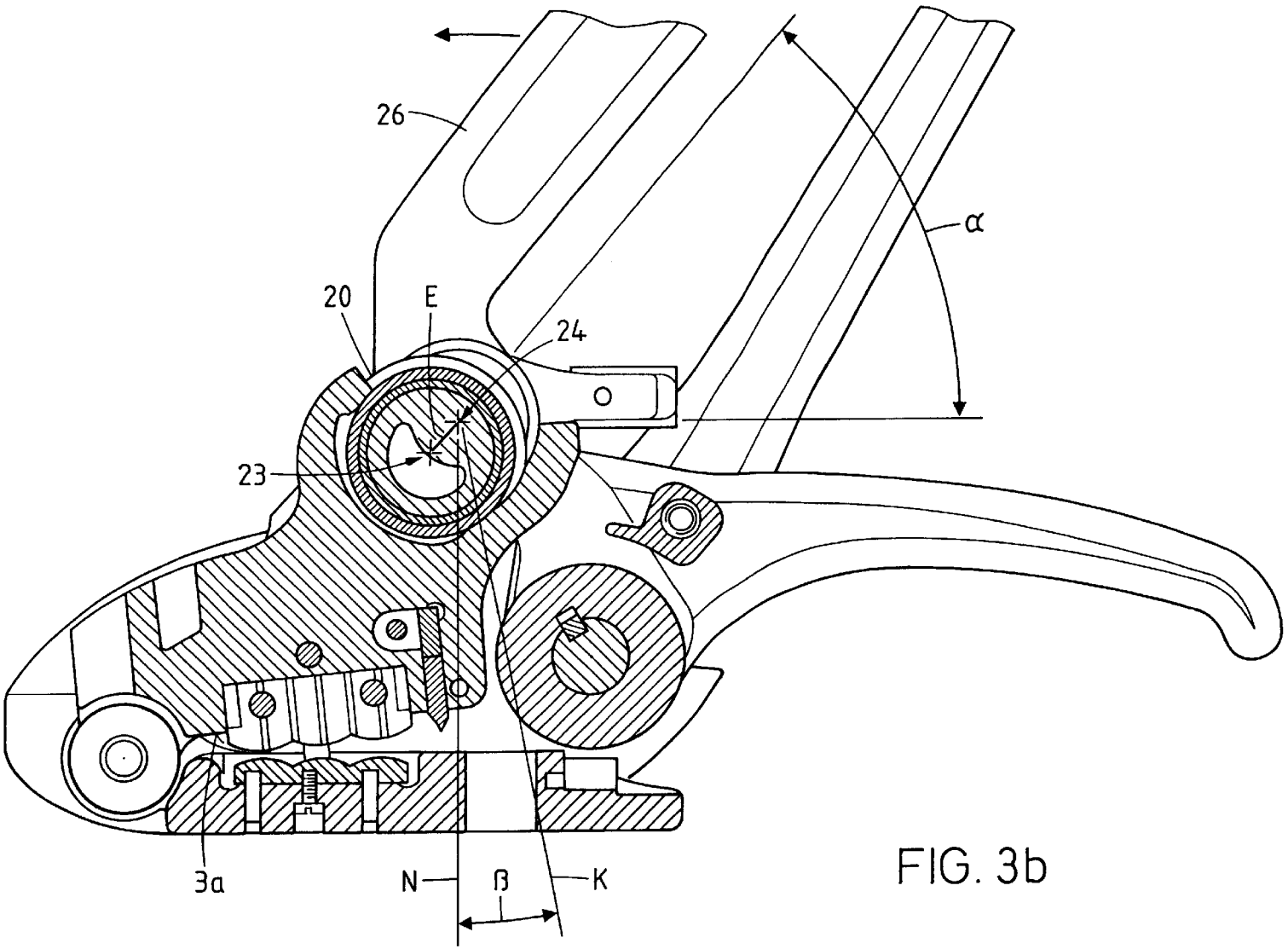
Figure 3C:
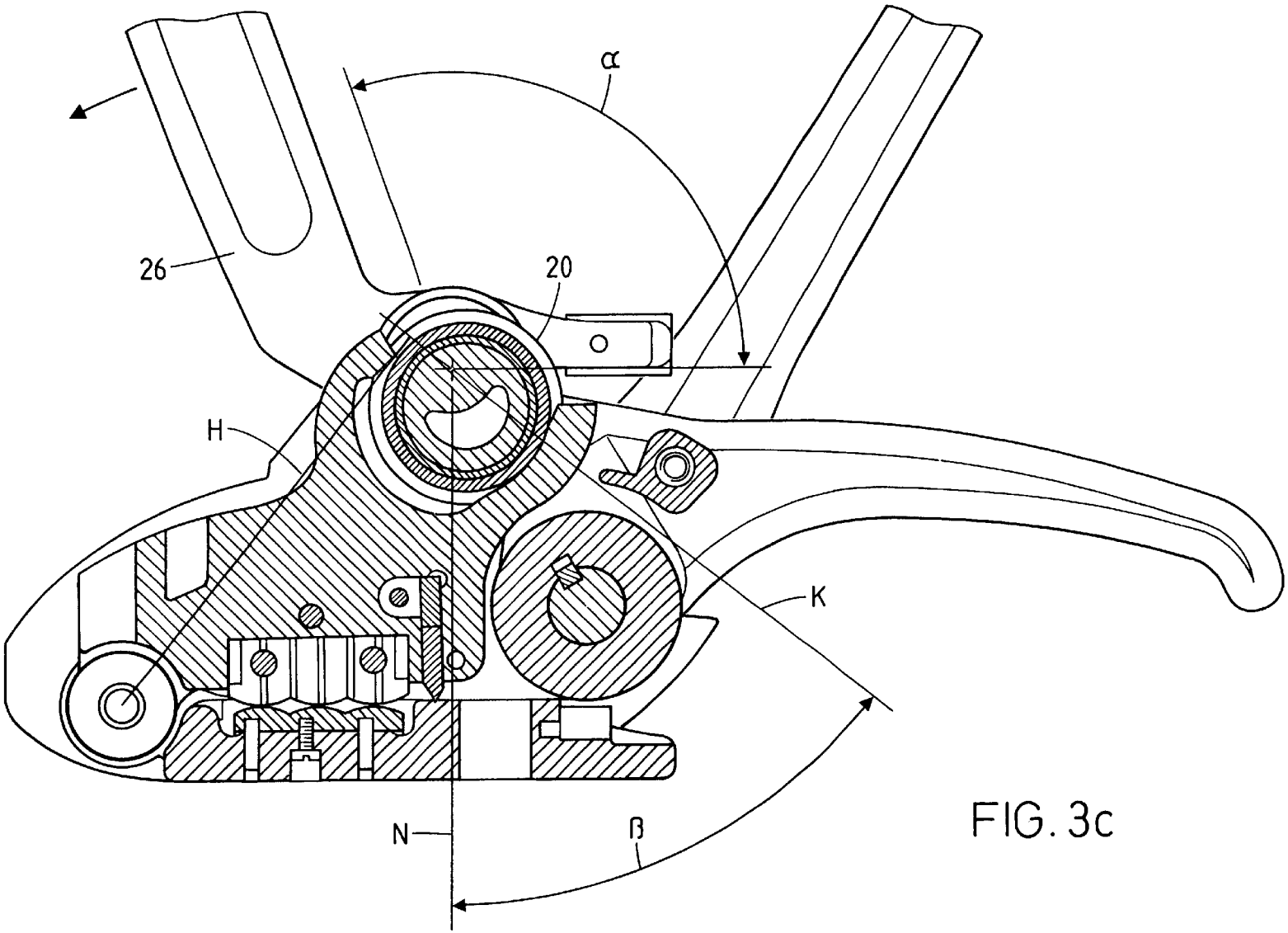
Figure 3D:
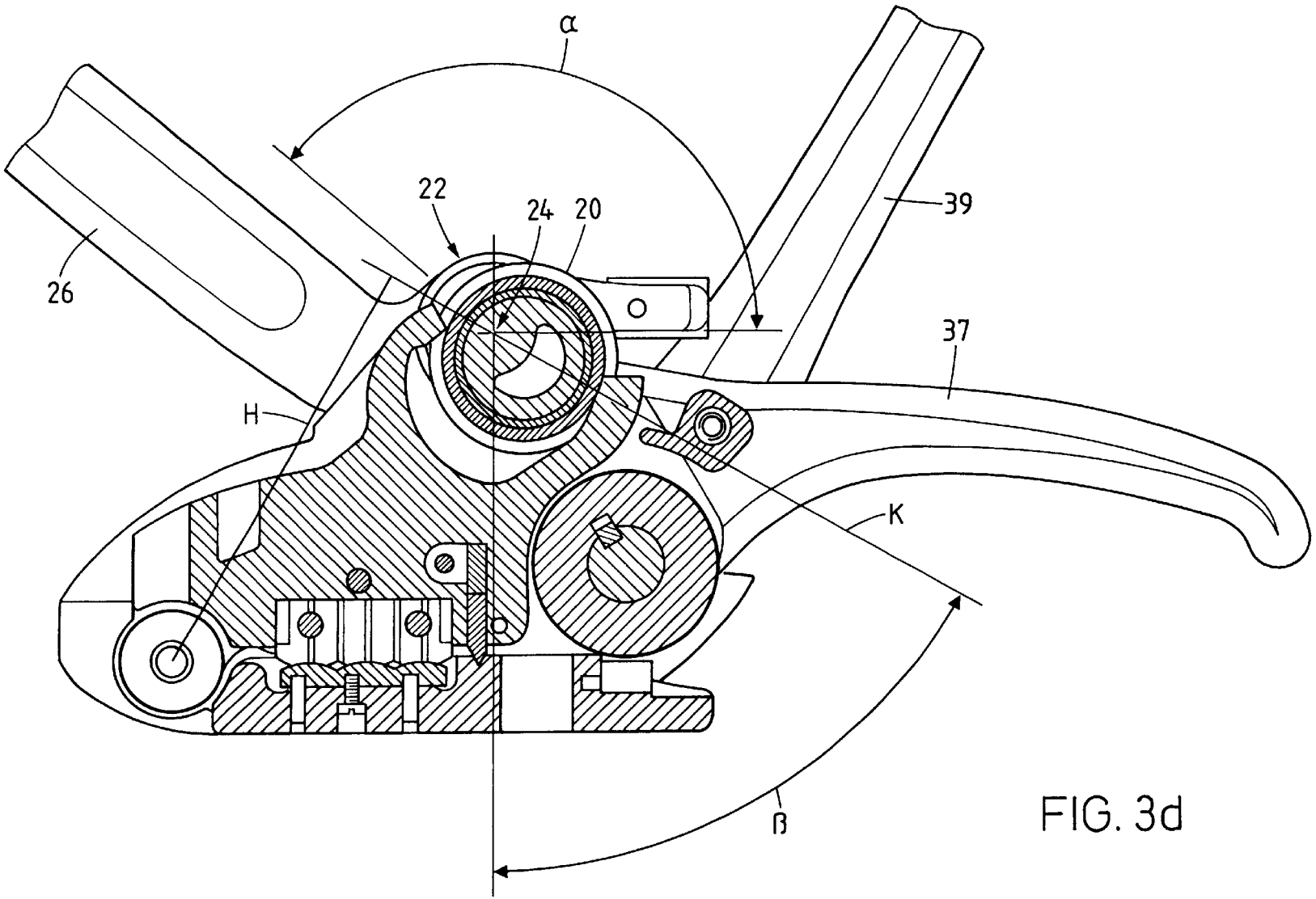
Figure 4:
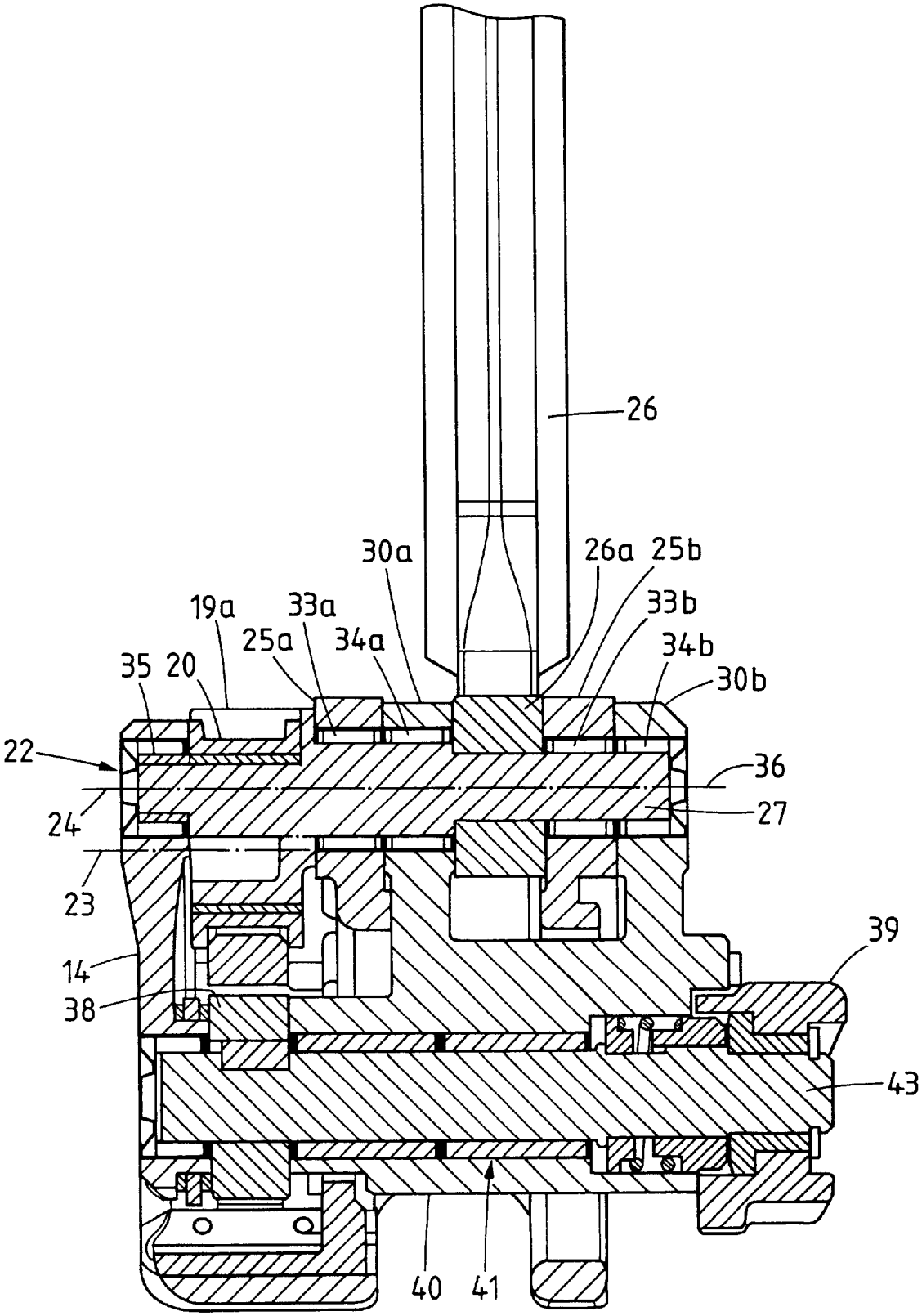
Figure 5:
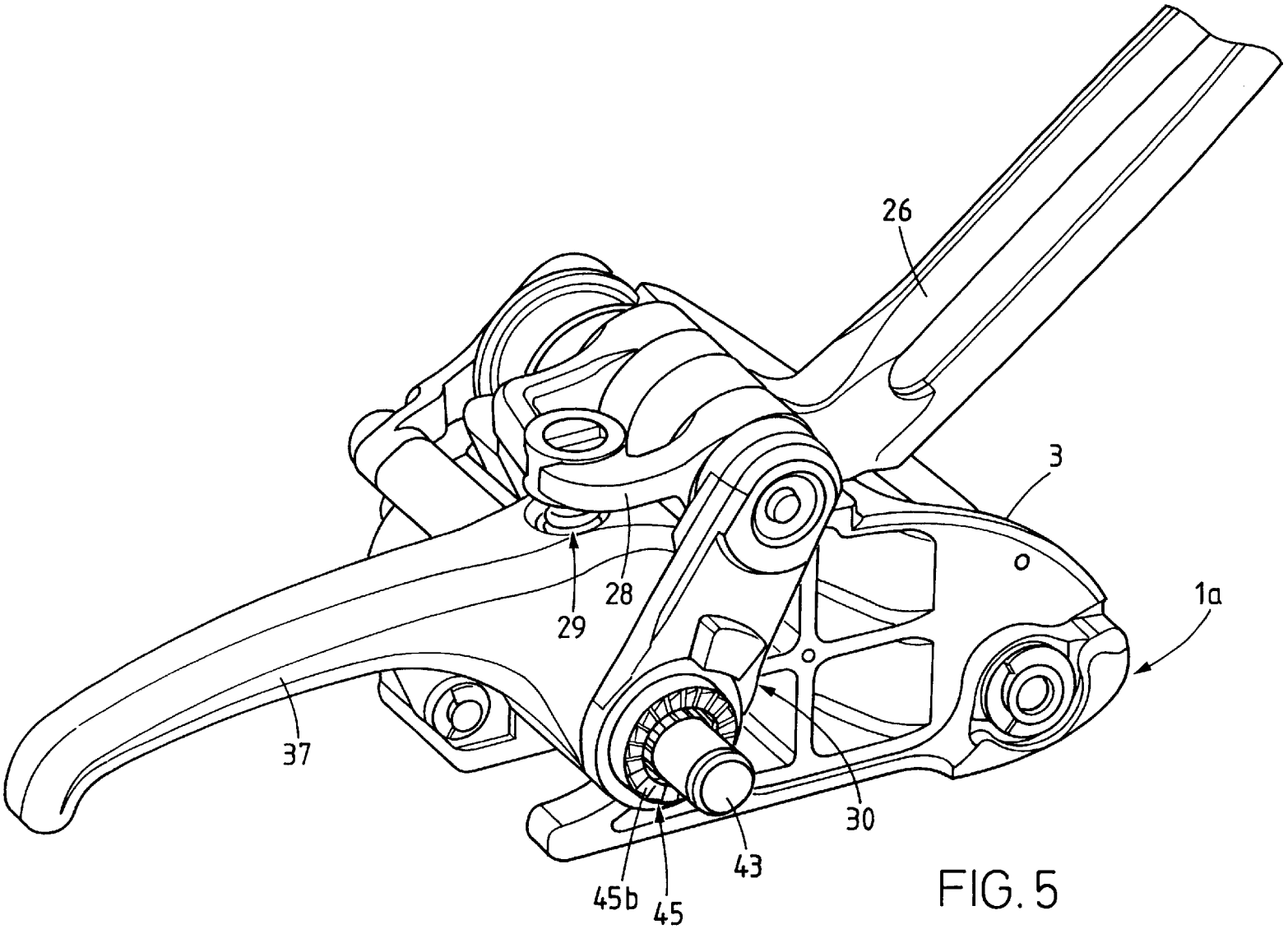
Figure 6:
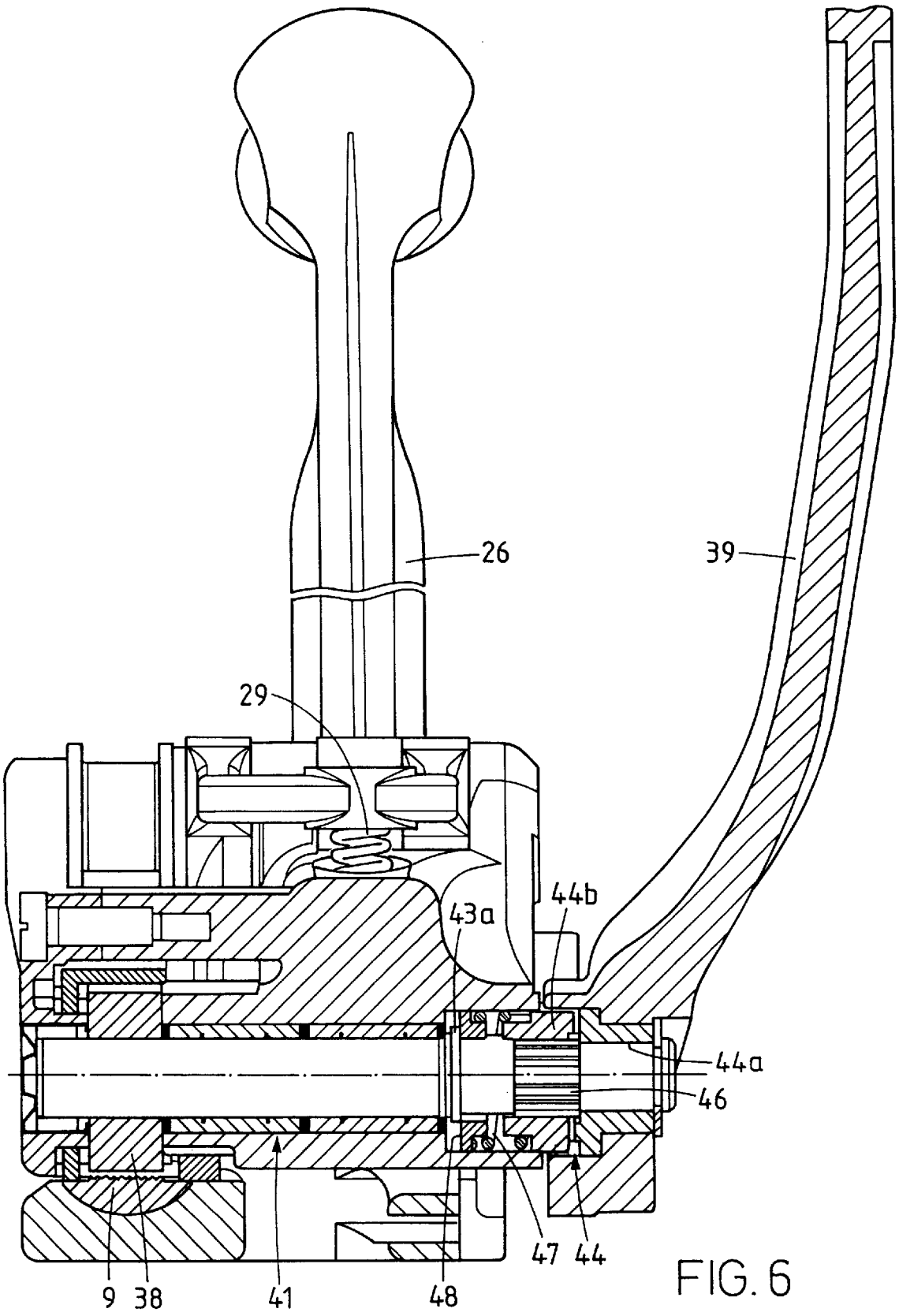
Figure 7:
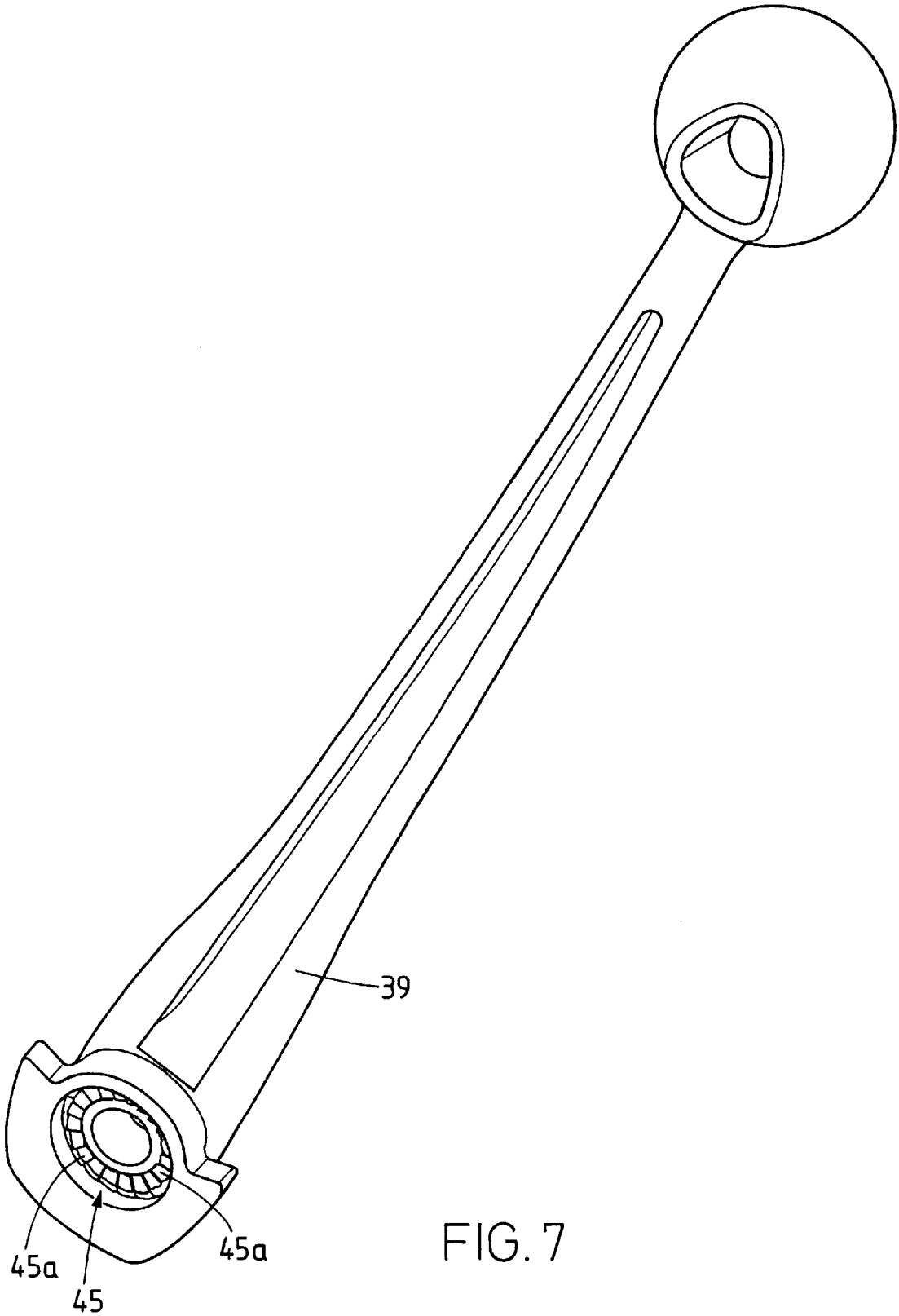
Figure 8A:
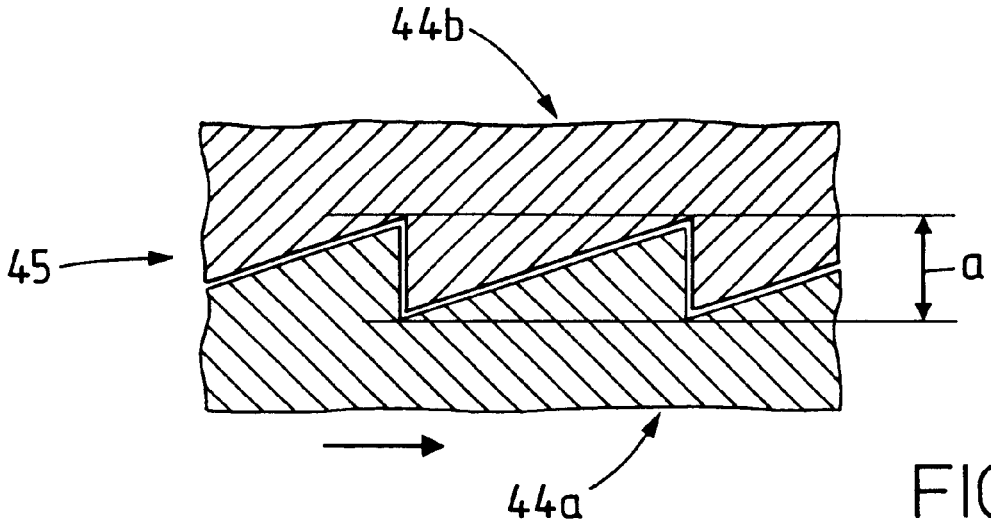
Figure 8B:
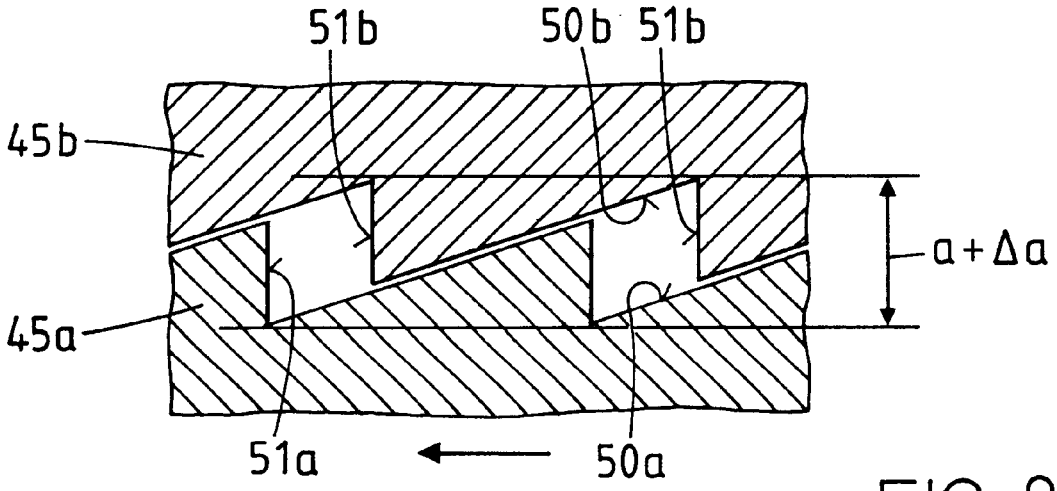
Figure 9:
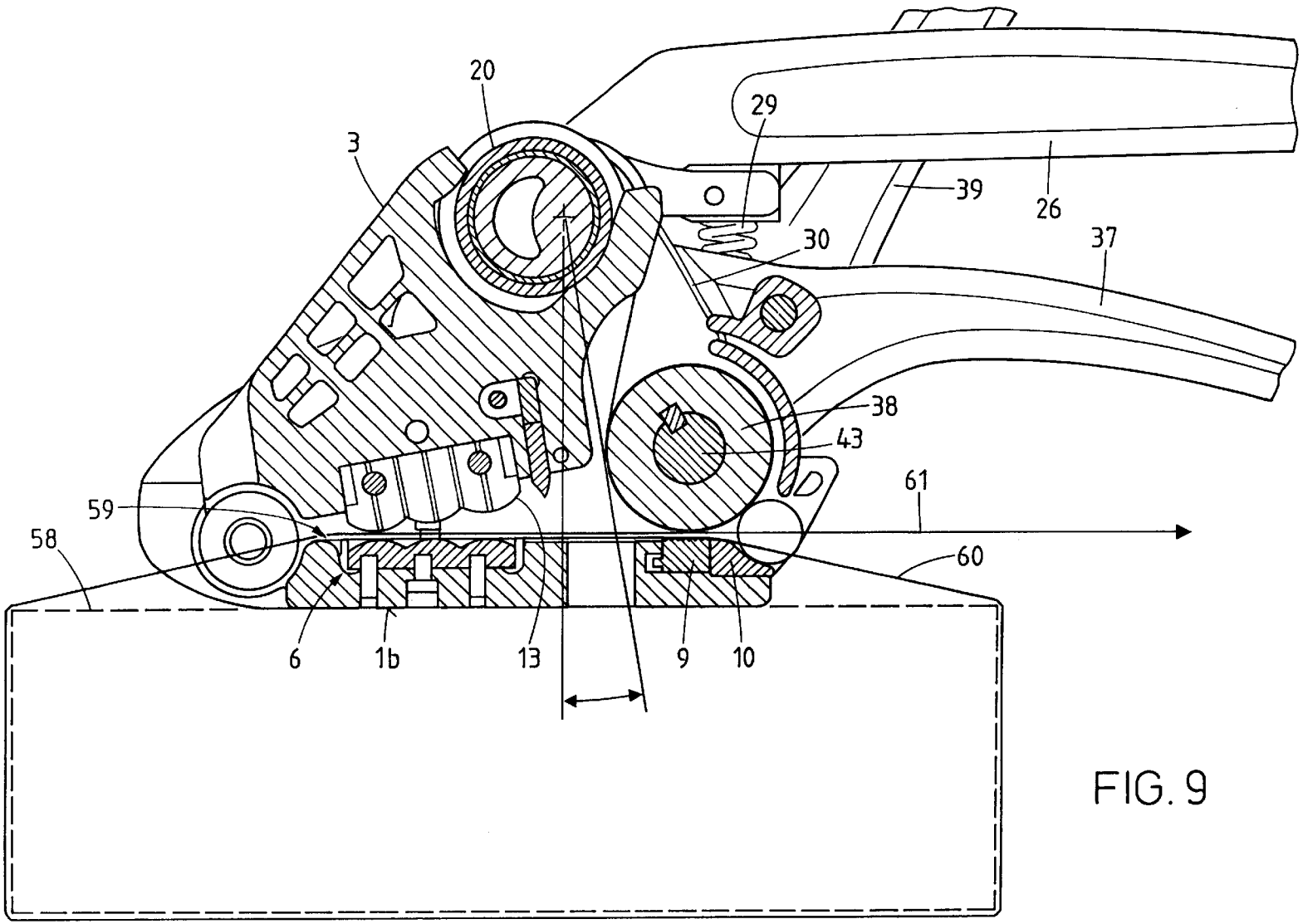
Figure 10:
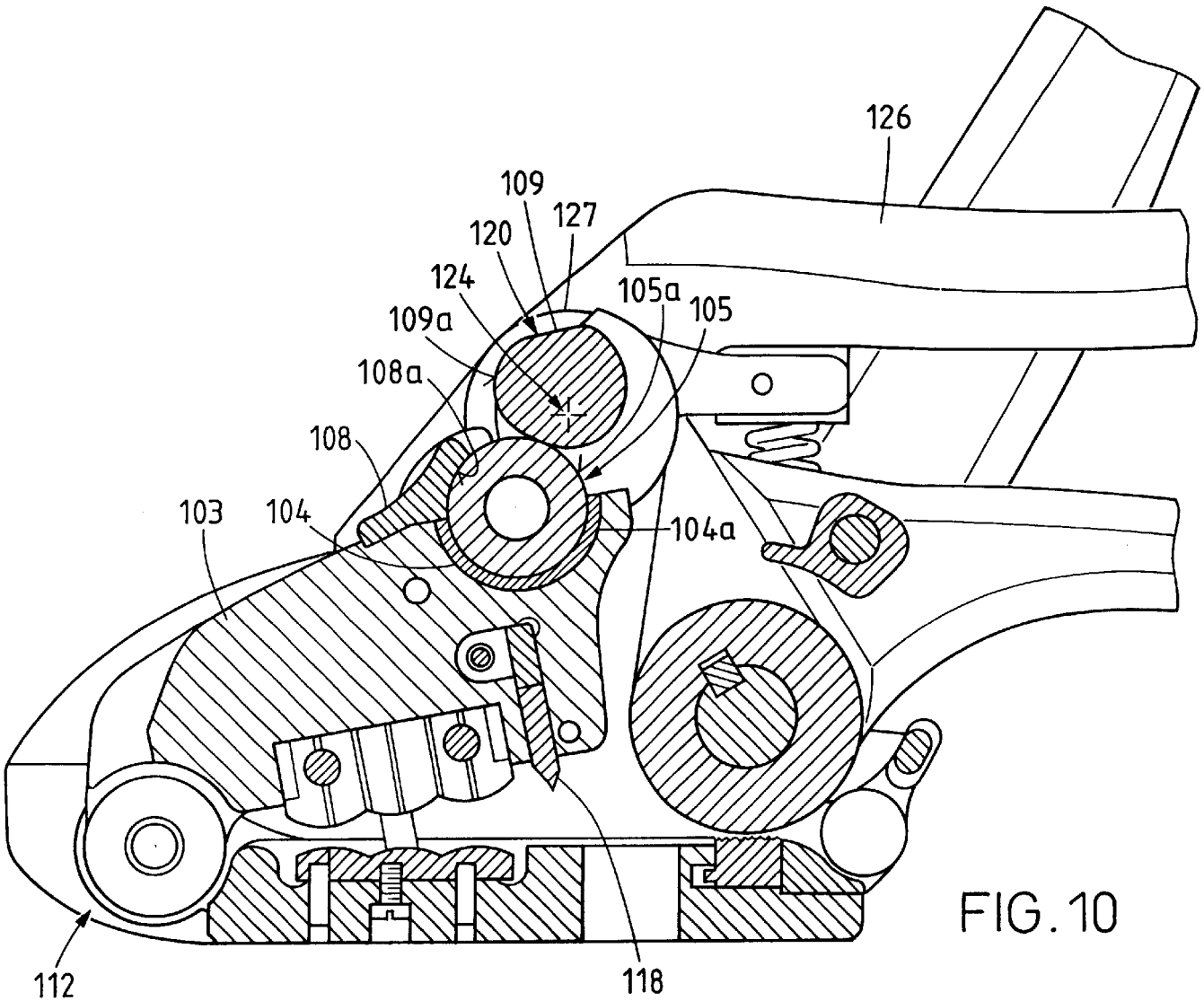

FIG. 3*a* shows a longitudinal sectional illustration of the strapping unit of FIG. 1, in which the sealing-device lever is situated in an open end position;

FIGS. 3*b*–3*d* show an illustration of the strapping unit according to FIG. 3*a*, in which the sealing-device lever is shown in two intermediate positions and in the sealing end position;

FIG. 4 shows an illustration of a cross section running both through a rotational axis and a tensioning axis of the strapping unit;

FIG. 5 shows a further perspective illustration of the strapping unit, in which, in comparison to the illustration of FIGS. 1 and 2, a housing and a tensioning lever are removed;

FIG. 6 shows a sectional illustration along a tensioning axis;

FIG. 7 shows a perspective illustration of a tensioning lever provided with a coupling part of an axial coupling;

FIG. 8*a* shows a detail of a longitudinal section through engaged segments of a Hirth-type serration;

FIG. 8*b* shows an illustration according to FIG. 8*a* after a relative movement of two coupling parts on which the segments are arranged;

FIG. 9 shows an illustration of the strapping unit according to FIG. 3*a* with a strap loop inserted into the strapping unit;

FIG. 10 shows a further exemplary embodiment in an illustration according to FIG. 3*a;*

Figure 11:
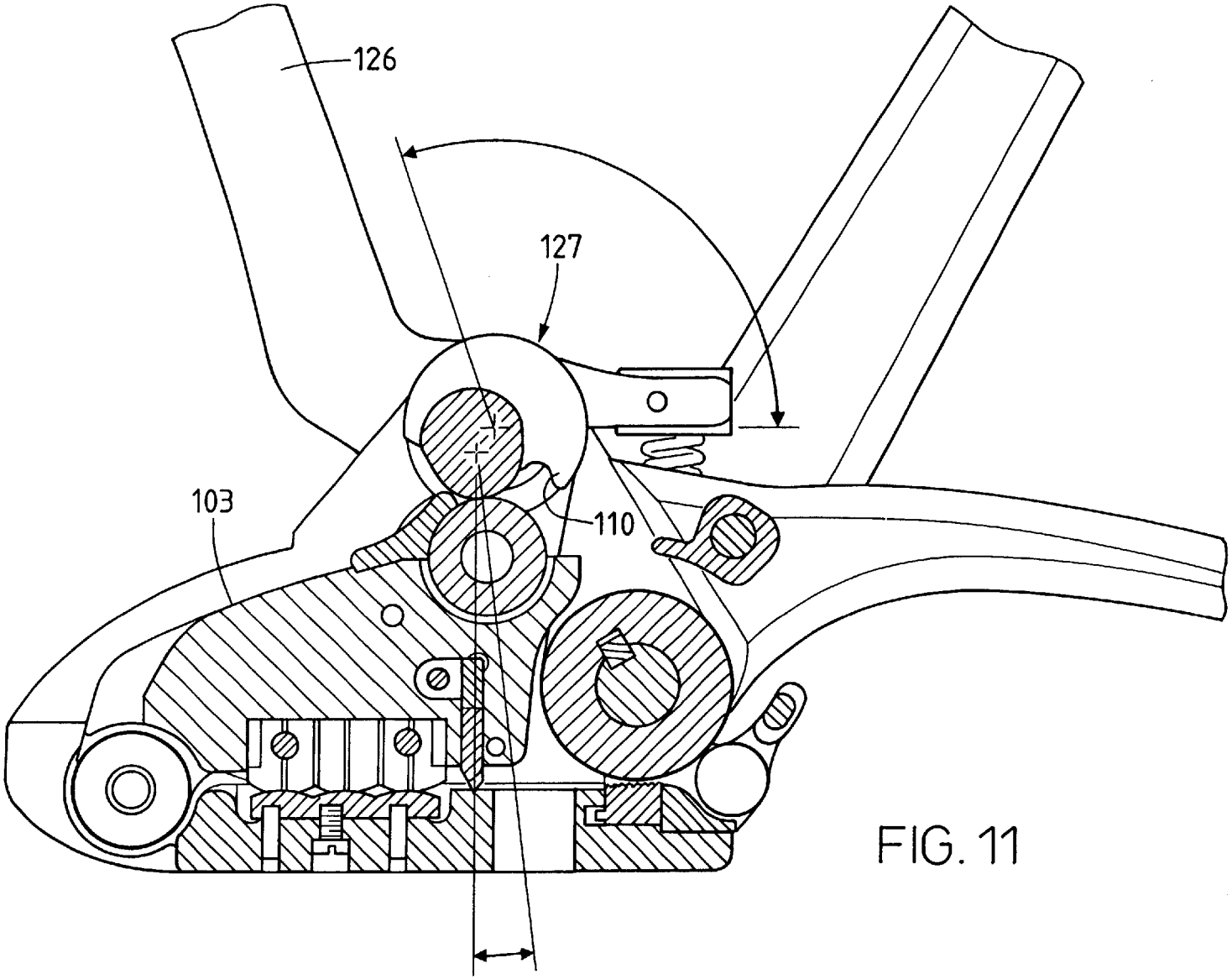
Figure 12:
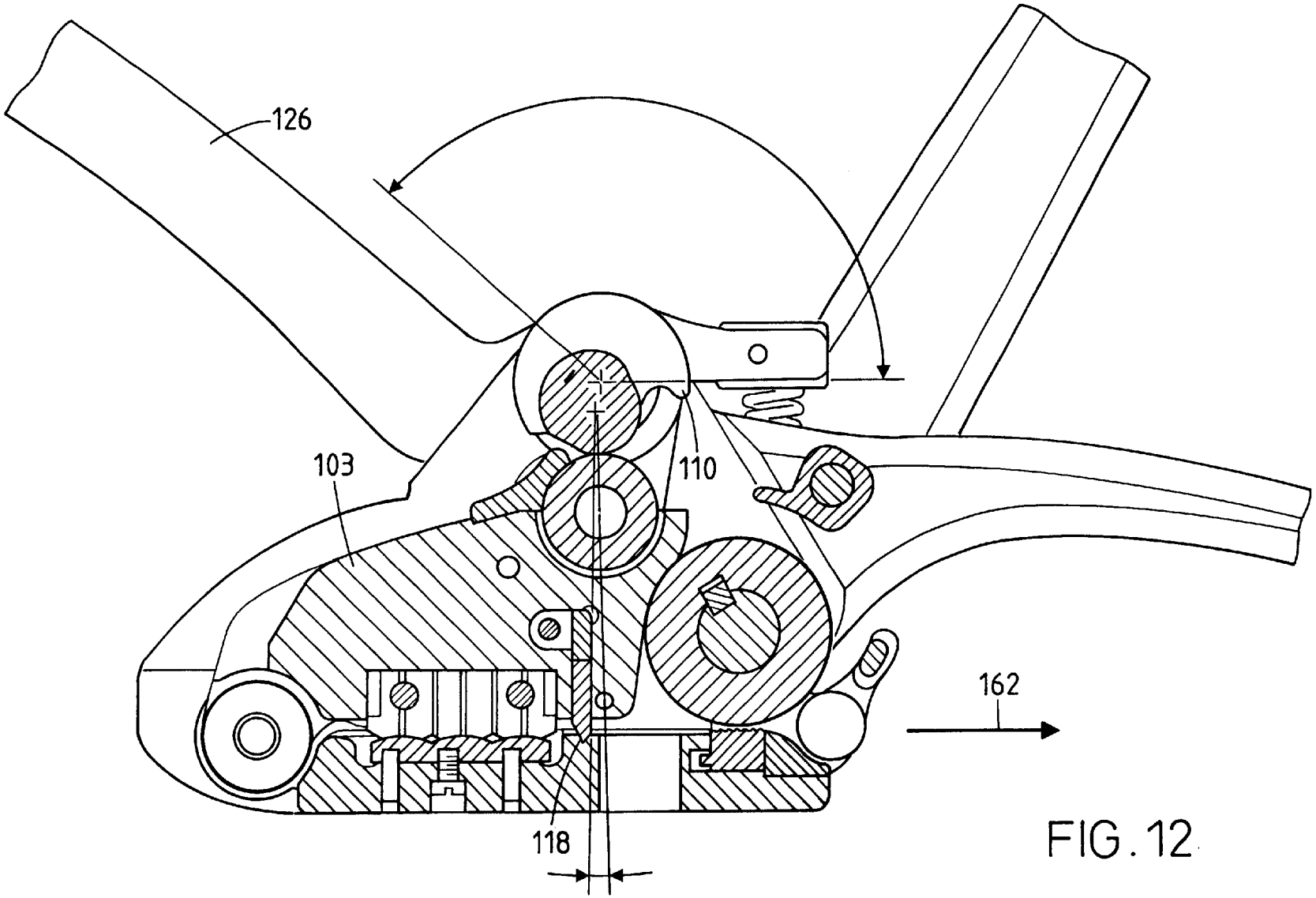
Figure 13:
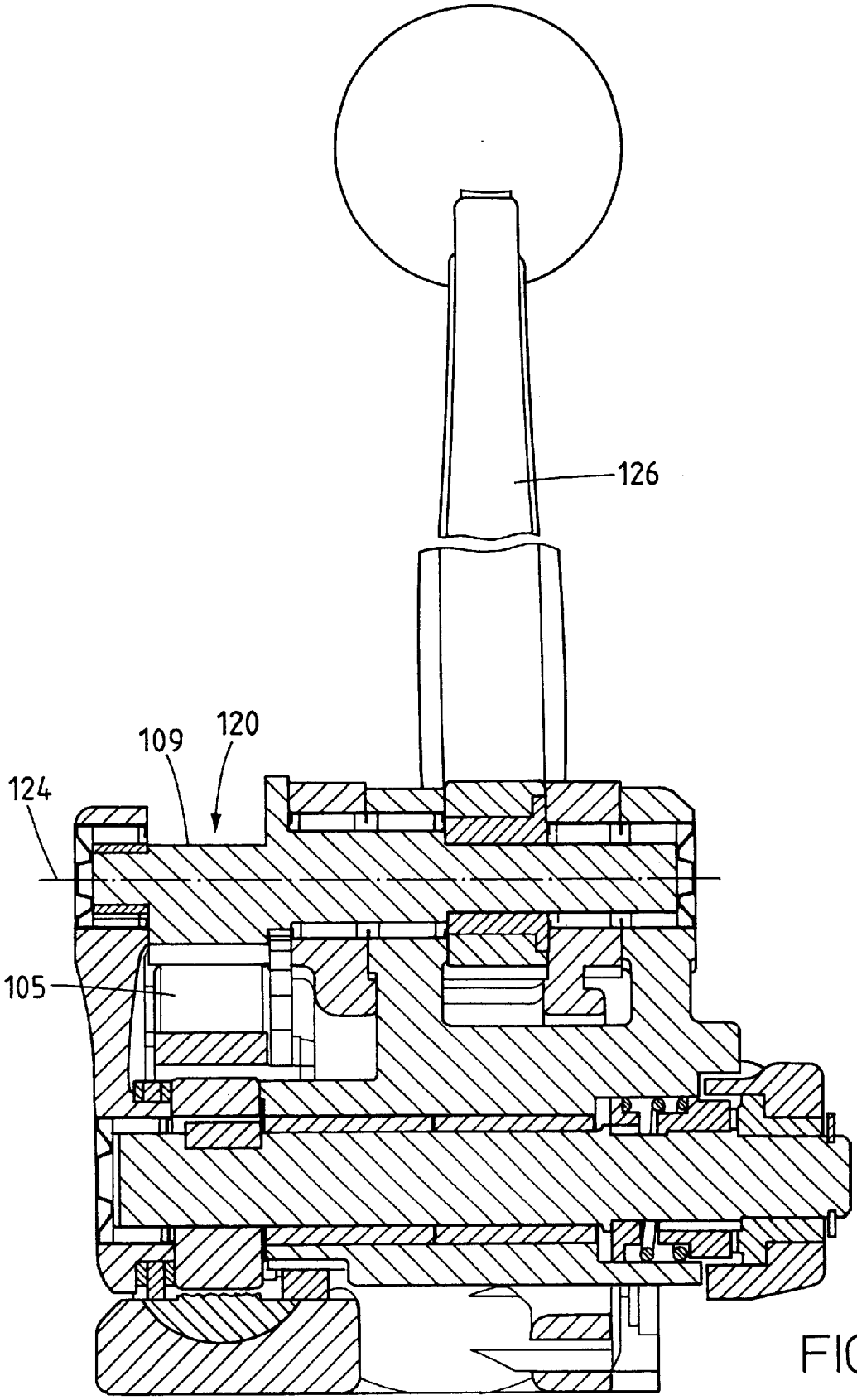

FIGS. 11, 12 show two illustrations of the strapping unit from FIG. 10, in which the sealing-device lever is shown in an intermediate position and in the sealing end position;

FIG. 13 shows a sectional illustration of the exemplary embodiment from FIG. 10 according to the illustration from FIG. 4.

The exclusively manually actuated strapping unit shown in FIGS. 1 and 2 has a base plate 1 and a die-plate carrier 3, which is mounted pivotably on a bearing point 2 in the region of a front end 1*a* of the base plate 1. The die-plate carrier is covered in FIGS. 1 and 2 by a housing 4, but can be seen better in FIGS. 3*a*–3*d*. A positionally fixed carrier 5, which is connected integrally with the base plate 1 and is used in particular for accommodating bearing points is arranged laterally next to the die-plate carrier. The carrier can be seen in particular in FIG. 5.

As can be gathered in particular from FIGS. 3*a* to 3*d*, in the base plate 1 a punch 6 is inserted from above into a recess of the base plate 1. The punch 6 is fastened to the base plate 1 by means of at least one screw 7, introduced from a supporting surface 1*b* of the base plate 1, and bolt pins 8 and is a constituent part of a sealing device. A bearing surface 1*d* of the base plate 1 is provided directly behind the punch, in the direction of the rear end of the base plate Finally, in the region of the rear end 1*c* of the base plate 1 a toothed plate 9 (FIG. 9) which is profiled on an upper side is inserted into the base plate and a retaining plate 10 bears against it. The retaining plate 10 is screwed onto the base plate 1 and therefore fixes the toothed plate 9 in place.

The die-plate carrier 3 is mounted at the front end of the carrier 5 of the strapping unit by means of a rotary bearing 12 designed as a radial rolling bearing. A rotational axis of the rotary bearing 12 runs essentially transversely to an alignment of the strap arranged in the strapping unit and therefore perpendicularly with respect to the plane of projection in FIGS. 3*a*–3*d*. As a further constituent part of the sealing device, the die-plate carrier 3 has a two-part die-plate 13, of which only the front die-plate part 13*a* can be seen in the illustration of FIG. 1. The die-plate 13 is inserted into a recess on the lower side 3*a* of the die-plate carrier, which side faces the base plate 1. In order to secure the die-plate 13, it is pushed onto a pin 17 of the die-plate carrier 3 and is screwed to the die-plate carrier 3 by means of two screws 15, 16 (FIG. 3*a*). The die-plate 13 and the punch 6 can be designed in a manner substantially corresponding to the sealing tools shown in DE 38 41 489 C2 or CH 659 221 A5. Toward the rear end of the strapping unit a notching tool 18, which is designed as a notching blade, is inserted into the die-plate carrier, likewise on the lower side thereof. A notched cutter 18*a* of the separating means protrudes by a predetermined length over the lower side 3*a*. The notching tool 18 belongs to a separating means of the strapping unit, with which a section of a steel strap can be severed by a shearing operation.

On a side facing away from the base plate 1, the die-plate carrier 3 has, on an upper side, a receptacle 19 for a transmission element 20. For this purpose, the receptacle 19 is of approximately fork-shaped design, the two fork struts 19*a*, 19*b* in each case being bent toward each other. The fork strut 19*b*, which is closer to the rear end 1*b* of the base plate, is provided with an inner rolling surface 19*c* which is shaped in such a manner that the transmission element 20 can roll on it for a certain distance during a pivoting movement of the die-plate carrier 3. The shape of the other fork strut 19*a* is configured to the effect that the transmission element 20 can, on the one hand, move in the predetermined manner in the receptacle 19 during a pivoting movement, but, on the other hand, is retained securely between the two fork struts 19*a*, 19*b*.

In the exemplary embodiment illustrated, the transmission element 20 is a roller which, with its eccentric axis 23, is arranged eccentrically with respect to a rotational axis 24 of a rotational bearing 22, which is explained in more detail below (cf. also FIG. 4). The eccentricity is denoted in FIG. 3*b* by E. In order to reduce the wear, this roller is provided with an outer sliding ring with which the transmission element 20 comes into contact with the fork struts 19*a*, 19*b* of the die-plate carrier 3. As can be seen in particular from FIG. 2, the rotational bearing 22 is supported on the carrier 5 via a bearing fork 25. The rotational bearing can be actuated via a sealing-device lever 26 which is connected non-rotatably to a shaft 27 of the rotational bearing (for rotation in common). Also connected to the positionally fixed bearing fork 25, which is connected to the carrier 3, is an abutment 28 against which a rocker 30 (described in greater detail below) is supported via a spring 29.

As can be gathered in particular from the sectional illustration of FIG. 4, the sealing-device lever 26 is arranged non-rotatably with an annular part 26*a* on the rotational shaft 27 (for rotation in common). Annular ends 25*a*, 25*b* of the bearing fork 25 are also provided on both sides of the sealing-device lever. A respective needle bearing 33*a*, 33*b* is provided in the ends 25*a*, 25*b* of the bearing fork 25, for the mounting of the rotational shaft 27.

One of two fork-shaped limbs 30*a*, 30*b* of the rocker 30 is on one hand arranged between the sealing-device lever 26 and a first of the ends 25*a* of the bearing fork and the on the other hand arranged on the right-hand, outer side on the rotational shaft 27 next to the second end 25*b* of the bearing fork. The rocker 30 can be seen, inter alia, also in FIG. 2 and will be explained in greater detail below. The limbs 30*a*, 30*b* of the rocker are also mounted on the rotational shaft 27 by means of needle bearings 34*a*, 34*b*. In the illustration of FIG. 4, the transmission element 20 arranged on the other end of the rotational shaft 27 can finally also be seen. The transmission element 20 is mounted rotatably with respect to the rotational shaft 27 by means of a sliding bearing 35.

As has already been discussed above, the rocker 30 of the tensioning device is mounted rotatably on the rotational shaft 27, at an end of the said rotational shaft which lies opposite the transmission element 20. Since the rocker 30 is arranged on the same shaft as the sealing-device lever 26, the rotational axis 24, by means of which the sealing-device lever 26 causes the rotational shaft 27 to rotate, is aligned with a pivot axis 36 of the rocker 30. However, since the rocker 30 is arranged with radial bearings on the shaft, rotational movements of the shaft 27 are decoupled from the pivoting movement of the rocker 30. Both the rotational axis 24 and the pivot axis 36 run essentially parallel to the axis of the rotational bearing 12.

According to FIG. 5, a handle 37 is also connected fixedly to the rocker 30 and can be used to actuate the rocker in the form of a pivoting movement about the rotational axis and pivot axis 24, 36, respectively. The compression spring 29 which is supported on the abutment 28 acts on the handle 37. The rocker 30 can therefore be pivoted from a tensioning position, which is shown in the figures and in which a tensioning wheel 38 (FIG. 3*a*) bears against the toothed plate 9 or against a strap guided over the toothed plate, into a neutral end position (not shown in the figures) and back again into the tensioning position. In the neutral end position, the tensioning wheel is arranged at a distance from the toothed plate. Without acting on the rocker, the said toothed plate always assumes the tensioning position because of the spring force acting on it.

A tensioning lever 39, with which the tensioning wheel 38 (FIG. 3*a*) can be caused to rotate, is fitted on an end of the rocker 30 lying opposite the rotational bearing 22 (FIG. 2). As can be seen in particular from FIG. 1 and FIG. 4, a tensioning shaft 43 is mounted rotatably in a cylindrical part 40 of the rocker 30. At the two ends of the tensioning shaft 43, the tensioning lever 39 is situated at one end and the tensioning wheel 38, which is arranged non-rotatably on the tensioning shaft (for rotation in common), is situated at the other end. As can be seen in FIGS. 4 and 6, the tensioning shaft is mounted rotatably in the rocker 30 by means of a clamping-body free-wheel based on a radial needle bearing. For the present exemplary embodiment, the sleeve-type free-wheel with mounting HFL 1626, which is provided by INA Wälzlager Schaeffler oHG, Herzogenaurach (Germany), shown inter alia, in Catalog 306/1991 has proven suitable. Free-wheels of this type only permit rotation in one direction of rotation. They block the shaft supported by them against rotations in the other direction of rotation.

In the region of the tensioning lever 39, an axial coupling 44 (FIG. 4 and FIG. 6) is situated on the tensioning shaft—and therefore in the force flux between the tensioning lever and the tensioning wheel. The axial coupling 44 can be used to bring the tensioning lever 39, which can be rotated by means of a radial bearing (not illustrated in greater detail), together with the tensioning shaft 43 into and out of engagement.

The axial coupling 44 has two coupling parts 44*a*, 44*b* which are both provided with a Hirth-type serration 45 (FIG. 5 and FIG. 7). As is shown in particular in FIG. 6, one of the two coupling parts 44*a*, 44*b* has a bushing on the side of the lever, on which the lever is fastened, and, on the other side, a driver provided with a linear internal toothing. The driver 44*b* is arranged on a linear external toothing 46 of the tensioning shaft 43, which toothing is on the circumference, and is connected to the latter in a positive locking manner. The driver 44*b* is supported via a compression spring 47 against a bearing ring 48 which, in turn, bears against a shoulder 43*a* of the tensioning shaft 43. If a correspondingly large compressive force is exerted on the driver 44*b* in the direction of a tensioning axis 49 running parallel to the rotational axis 24, then the driver 44*b* can be axially displaced counter to the spring force in the direction of the tensioning wheel 38 on the tensioning shaft 43 and can subsequently be pushed back again into its initial position by the tensioned spring.

As sketched in FIGS. 8*a* and 8*b*, the Hirth-type serration 45 has, on annular surfaces of each coupling part 44*a*, 44*b* which surfaces are orientated essentially orthogonally with respect to the tensioning axis, a plurality of segments 45*a*, 45*b* which are geometrically identical in each case, rise with a ramp-like surface 50 by the amount a in the direction of the tensioning axis 49 and then drop with a steep flank surface 51, which runs essentially parallel to the tensioning axis, to the foot of the respectively adjacent segment. The flank surfaces 51 are aligned at least substantially radially with respect to the tensioning axis 49. With regard to longitudinal sections which run parallel to the tensioning axis, the segments are therefore of essentially triangular design.

Owing to the described arrangement of the segments 45*a*, 45*b* of the two coupling parts 44*a*, 44*b*, the ramp-like surfaces 50 of segments 45*a*, 45*b* of different coupling parts slide on one another in a sheet-like manner only in a relative direction of rotation as is indicated in FIG. 8*b*. At the end of this sliding movement, the flank surface 51*a* of the segment 45*a* then always passes behind the flank surface 51*b* of a segment 45*b* of the other coupling part 44*b*. Since both the tensioning lever 39 and the tensioning shaft 43 do not change their position in the axial direction, it is necessary, in order to execute this movement, for the driver 44*b* to be pressed in the manner already described against the spring 47 and in the process to execute an axial displacement, the length of which corresponds to the height or length of the flank surfaces 51. During this movement the tensioning lever 39 can therefore be rotated about the tensioning shaft 43 which is stationary and is blocked by the free-wheel 41. The tensioning lever 39 is therefore decoupled from the tensioning shaft. If, in contrast, the tensioning lever 39 is actuated in the reverse direction of rotation, flank surfaces 51*a* of the tensioning lever press against flank surface 51*b* of the driver 44*b*. The tensioning lever is coupled to the tensioning shaft, as a result of which the rotational movement of the tensioning lever causes a rotation of the tensioning wheel 38.

In order to tension a strap loop around a packaged item 58 (merely shown schematically in FIG. 9) using the illustrated strapping unit according to the invention, first of all the strap can be placed loosely around the packaged item 58, so that two strap layers 60, 61 lie one above the other in the region of the free strap end 59.

The strapping unit is then arranged by means of its supporting surface 1*b* of the base plate 1 on the packaged item, the die-plate carrier 3 being arranged in its open end position and the tensioning wheel 38 being arranged in its neutral end position. As a result, the two strap layers 60, 61 lying one above the other can be guided over the base plate 1 of the strapping unit, with the result that the strap is situated between the die-plate 13 and the punch 6. By means of a pivoting movement of the rocker 30 counter to the spring force of the compression spring 29 a gap can then also be provided between the tensioning wheel 38 and the toothed plate 9. For this purpose, an operator can grip the handle 37, and the sealing-device lever 26 which is arranged in its open end position, with one hand and can press the handle 37 upward in the direction of the sealing-device lever 26. After the two strap layers 60, 61 have been introduced into the gap, the handle is released, as a result of which the compression spring 29 moves the rocker 30 back again in the direction of the toothed plate 9 into its tensioning position. The two strap layers 60, 61 are thereby clamped between the tensioning wheel 38 and the toothed plate 9. In this connection, the lower strap layer 60 rests with the free strap end 59 on the punch 6 and on the bearing surface 1*d* of the base plate. The other strap layer 61 which leads to a supply reel (not illustrated) is situated above the free strap end and projects behind the tensioning wheel out of the strapping unit. This situation is shown in FIG. 9.

The strap loop can then be tensioned by actuation of the tensioning lever 39. For this purpose, the tensioning lever 39 is pivoted to and from a number of times between its two end positions. During its pivoting movement in the anticlockwise direction (with regard to the illustrations of FIGS. 3*a*–3*d*) there is a positive lock between the two coupling parts 44*a*, 44*b*. The tensioning wheel is therefore caused to rotate in the anticlockwise direction. Because of a frictional lock between the upper strap layer 61 and the tensioning wheel 38, the upper strap layer is pulled further out of the strapping unit and the strap loop is provided with tension. In contrast, the lower strap layer 60 is retained unchanged in position because of the profiling of the toothed plate 9. During the pivoting movement of the tensioning lever in the clockwise direction, in contrast, the positive lock between the coupling parts 44*a*, 44*b*, and therefore also between the tensioning lever 39 and the tensioning shaft 43, is canceled. The tensioning wheel 38 is therefore not carried along in this direction of movement. Owing to the free-wheel 41, the tensioning wheel 38 and the tensioning shaft 43 also do not rotate back during the decoupling of the tensioning lever 39, but remain in their current rotational position. The oscillating movement of the tensioning lever is repeated until a sufficient tension is applied to the strap.

The strap loop is subsequently sealed. For this purpose, the sealing-device lever 26 and the transmission element 20 are transferred from its open end position (FIG. 3*a*) into its sealing end position (FIG. 3*d*). In the exemplary embodiment illustrated, during this process the sealing-device lever covers an angle of rotation $\alpha$ of approximately 140°. In the process, the eccentrically mounted roller rolls along the surface 19*c* of the limb 19*b* of the receptacle 19. The eccentricity E of the roller rotates here in the same direction of rotation as the sealing-device lever. At the end of the rotational movement, the roller bears against the surface 19*c* in the region of the free end of the limb 19*b*. The limb 19*b* is aligned to the angular position of the eccentricity in such a manner that, if possible, already after the first contact of the die-plate with the upper strap layer, the lever arm of the torque exerted on the die-plate carrier, the said lever arm being referred to in the drawings by H, is as large as possible. The lever arm arises as the distance of the rotary bearing 12 from the direction of the force normal K with which the roller presses at a particular moment in each case against the limb 19*b*. In the exemplary embodiment illustrated, the size of the lever arm H even increases slightly toward the end of the pivoting movement of the die-plate carrier rotating in the clockwise direction, with respect to the direction of looking at FIGS. 3*a* to 3*d*.

In FIGS. 3*a* to 3*d*, which show the two end positions and an intermediate position of the sealing-device lever 26 and of the transmission element 20, it is also illustrated that the force normal encloses a negative angle $\beta$ with respect to a normal N of the supporting surface 1*b*, which normal runs through the rotational axis 24, or of the bearing surface 1*d* which is parallel thereto. Starting from the open end position, this negative angle becomes increasingly large up to the sealing end position. In this connection a "negative angle" is understood to be an angle which—starting from the normal N—is to be measured in the anticlockwise direction. In FIGS. 3*a*–3*d*, it can also be seen particularly readily that the normal N of the supporting surface which normal runs through the rotational axis 24, lies in the tensioning direction (arrow 62) behind the point at which the notching tool 18 presses against the base plate 1 or against the strap 61.

Owing to the comparatively long lever arm H, the strap can be deformed right from the beginning of contact of the upper strap layer with that end of the die-plate 13 which is at the front in the tensioning direction 62. Since the lever arm H can even increase slightly toward the end of the pivoting movement due to its construction, the torque increases whenever the sealing device also has to act on a relatively larger strap surface. By this means, it is reliably ensured that an additive-free, i.e. in particular a lead-free and weld-free, seal is formed by the die-plate and the punch in the strap itself, the said seal not being released even at high strap tension. Directly before the sealing end position is reached, the notched cutter notches into the upper strap layer, which is still connected to a strap supply and severs it from the strap supply. Subsequently, the sealing-device lever can be transferred again into its open end position, the tensioning wheel can be lifted off the strap by actuation of the rocker and the strapping unit can be removed by guiding it away laterally from the finished strap loop.

FIGS. 10–13 show a further exemplary embodiment of a strapping unit according to the invention. Since the latter has great similarity with the previously described exemplary embodiment, only the differences will be discussed below.

FIG. 10 shows that, in contrast to the first exemplary embodiment, here a roller 105, which is provided as a second transmission element, is inserted in a half shell 104, which is placed in the die-plate carrier 103, below the rotational axis 124. The half shell 104 has approximately the shape of a hollow cylinder severed along a longitudinal axis, the longitudinal axis of the half shell 104 running approximately parallel to the rotational axis 124. Furthermore, a retaining strip 108 is screwed on the die-plate carrier 103, directly in front of the half shell 104. The said retaining strip has a surface 108*a* which is in the shape of a circular arc in cross section, adjoins the half shell 104 and therefore also surrounds part of the cylindrical circumferential surface 105*a* of the roller 105. The roller 105 is therefore arranged in a freely rotatable manner in the half shell 104, which is provided with a sliding lining 104*a*, the roller 105 being prevented from falling out of the half shell 104 by the retaining strip 108.

A section of the rotational shaft 127 situated directly above the roller 105 is designed as a cam 109 which is arranged eccentrically with respect to the rotational axis 124. In the case of this exemplary embodiment, the cam 109, which is connected integrally to the rotational shaft, therefore takes over the function of the transmission element 120. By means of an eccentric surface 109*a* of the cam, the rotational shaft 127 is in contact with the circumferential surface 105*a* of the roller 105 and therefore transmits a rotational movement of the rotational shaft 127 to the die-plate carrier 103. By means of the differing distance of the eccentric surface 109*a* along the circumference of the eccentric cam 109 with respect to the rotational axis 124 and the rotational movement of the rotational shaft 127, during a pivoting movement (in the anticlockwise direction with regard to the illustration of FIG. 10) of the sealing-device lever 126 the die-plate carrier 103 can be pressed by the cam 109 from its open end position into its sealing end position. During the transfer of the sealing-device lever from its open end position into the sealing end position another linear contact region of the transmission element of the eccentric surface 109*a* is always in contact with the roller 105. In the sectional illustration of FIG. 13 (which corresponds to the illustration of FIG. 4) of the second exemplary embodiment, the structure of the unit, which is slightly changed with respect to the first exemplary embodiment, in the region of the transmission element 120 can likewise be seen. This illustration also reveals the cam 109 which is connected integrally to the rotational shaft and acts on the roller 105 mounted in the die-plate carrier.

If the sealing-device lever 126 is moved back out of its sealing end position in the reverse direction of pivoting, then in this case a hook 110, which is shown in FIGS. 11 and 12, grips, in a positively locking manner, under a projection (which cannot be seen in the figures) of the die-plate carrier 103 and carries along the die-plate carrier 103. In the illustrations of FIGS. 12 and 13, the projection is situated behind the half shell 104. During the further course of the rotational movement of the rotational shaft 127, the die-plate carrier is then, on account of its rotational movement, which is caused by this means, about the bearing 112, lifted off the base plate 101 and transferred by the hook 110 into its open end position. In the strapping operation which follows next, on account of its rotational movement which then takes place in the anticlockwise direction (with respect to FIGS. 10–13), the hook 110 releases the die-plate carrier again, with the result that the latter can be transferred by the cam into its sealing end position.

Finally, it is revealed in FIG. 11, which shows the die-plate carrier 103 shortly before it reaches its sealing end position, that at this time the contact region between the cam 109 and the roller 105 is situated approximately directly above the notching tool 118. In the sealing end position itself, which is shown in FIG. 12, the contact region then migrates behind the notching tool 118. In another exemplary embodiment (not illustrated), however, the contact region could also be arranged approximately above the notching tool, in the sealing end position. Also in conjunction with these exemplary embodiments, the abovementioned positional details of the contact region are related in each case to the course of the tightening straps through the strapping unit, specifically to the direction from the bearing 112 to the rear end of the strapping unit (arrow 162).

In a similar manner as in the first exemplary embodiment, a direction of a force transmitted onto the die-plate carrier by the transmission element 120 should preferably also be orientated at least approximately vertically onto the strap. Furthermore, a force normal, which runs through the rotational axis 124 in the sealing end position and through the contact point between the cam 109 and the roller and which arises from the transmitted force, can preferably run approximately through the separating means or, with respect to the direction 162, can intersect the base plate of the unit behind the separating means.

What is claimed is:

1. Manually actuated transportable strapping unit for wrapping a tightening strap around a packaged item, which unit has a base plate which is provided with a supporting surface for arranging on a packaged item, furthermore has a sealing device, which sealing device is provided with a pivotable die-plate carrier which can be pivoted with respect to the base plate about a first bearing point, which is provided in the region of a front end of the base plate, from an open end position into a sealing end position and vice versa, a die-plate being arranged on the die-plate carrier, which die-plate can be lowered by the pivoting movement of the die-plate carrier in the direction of a punch arranged in the base plate, for which purpose a sealing-device lever is provided which can be pivoted about a second bearing point and whose pivoting movement can be transmitted to the die-plate carrier via a transmission element in a force-transmitting contact region of the die-plate carrier, has separating means on the die-plate carrier, with which the strap can be severed, and is provided with a tensioning device with which a strap tension can be applied to the tightening strap, the tensioning device having a tensioning lever with which a tensioning wheel arranged on a tensioning shaft can be actuated, characterized in that at least in the sealing end position a contact region of the transmission element (20, 120) with the die-plate carrier (3) is arranged, with respect to a direction running at least essentially parallel to the orientation (62, 162) of the strap between the sealing device and the tensioning wheel (38), approximately level with the separating means or behind the separating means.

2. Manually actuated strapping unit according to the preamble of claim 1, in which the tensioning wheel (38) is mounted pivotably on a rocker (30), characterized in that a pivot axis (36) of the rocker (30) and a rotational axis (24) of the sealing-device lever are at least substantially aligned with each other.

3. Strapping unit according to claim 2, characterized in that the transmission element (20, 120) and the rocker (30) are arranged on a common shaft (27, 127).

4. Strapping unit according to claim 1, characterized in that the transmission element (20, 120) is designed eccentrically with respect to the rotational axis (24) of the sealing-device lever (26, 126).

5. Strapping unit according to claim 1, characterized in that during the transfer of the sealing-device lever (26, 126) from the open end position into the sealing end position, the location of the contact point of the transmisssion element on the die-plate carrier (3, 103) or on a second transmission element (105), which is provided between the transmission element (20, 120) and the die-plate carrier (3, 103), changes.

6. Strapping unit according to claim 1, characterized in that a normal (N) of a supporting surface (1*b*) of the base plate (1), which normal intersects a rotational axis (24) of the bearing point of the sealing-device lever (26), and a normal (N) on the die-plate carrier or on a second transmission element enclose a negative angle (β) in the respectively instantaneous force-transmitting contact region of the transmission element with the die-plate carrier or with the second transmission element, in which case the sealing-device lever can be rotated anticlockwise in order to transfer it from its open end position into its sealing end position.

7. Strapping unit according to claim 6, characterized in that the angle (β) becomes larger during the transfer of the sealing-device lever (26) from the open end position into the sealing end position.

8. Strapping unit according to claim 1, characterized in that a direction of a force transmitted by the transmission element (20, 120) to the die-plate carrier (3, 103) or to a second transmission element aranged between the transmission element (20, 120) and the die-plate carrier (3, 103) intersects the base plate in the region of the seperating means or behind it.

9. Strapping unit according to claim 1, characterized in that an axial coupling is provided in a force flux running from the tensioning lever to the tensioning wheel.

10. Strapping unit according to claim 9, characterized in that two coupling parts of the axial coupling, which parts can be brought into and out of engagement, each have geometrically predetermined segments which can be used to obtain a positive lock in one direction of rotation and a free-wheel in an opposite direction of rotation.

11. Strapping unit according to claim 10, characterized in that segments of both coupling parts are, for producing the positive lock, provided with flank surfaces (51) which are orientated at least approximately parallel to the tensioning axis.

12. Strapping unit according to claim 11, characterized in that flank surfaces (51) of the two coupling parts can be brought in each case in pairs to bear in a sheet-like manner.

13. Strapping unit according to claim 10, characterized in that at least some of the segments are situated on an at least approximately annular axial surface which is arranged around the tensioning shaft or on the tensioning shaft itself, and the axial surface is connected non-rotatably to the tensioning shaft (for rotation in common).

14. Strapping unit according to claim 10, characterized in that a respective Hirth-type serration is provided on two elements of the axial coupling, which elements can be brought out of engagement.

15. Strapping unit according to claim 10, characterized in that an element of the axial coupling is arranged in a manner such that it can be displaced longitudinally along the tensioning axis.

16. Strapping unit according to claim 15, characterized in that the longitudinally displaceable element bears against a compression spring.

* * * * *